US005094450A

United States Patent [19]

Stearns

[11] Patent Number: 5,094,450

[45] Date of Patent: Mar. 10, 1992

[54] ABDOMINAL EXERCISE MACHINE

[76] Inventor: Kenneth W. Stearns, P.O. Box 55912, Houston, Tex. 77255

[21] Appl. No.: 735,167

[22] Filed: Jul. 23, 1991

Related U.S. Application Data

[63] Continuation of Ser. No. 542,521, Jun. 22, 1990, abandoned.

[51] Int. Cl.[5] ..... A63B 23/02

[52] U.S. Cl. ..... 272/134; 272/117; 272/130; 272/136

[58] Field of Search ..... 272/117, 130, 134, 136, 272/DIG. 4

[56] References Cited

U.S. PATENT DOCUMENTS

| | | | |
|---|---|---|---|
| 3,747,924 | 7/1973 | Champoux | 272/70 |
| 4,387,893 | 6/1983 | Baldwin . | |
| 4,600,196 | 7/1986 | Jones | 272/134 |
| 4,623,144 | 11/1986 | Rockwell . | |
| 4,627,619 | 12/1986 | Rockwell et al. . | |
| 4,666,152 | 5/1987 | Jones . | |
| 4,757,991 | 7/1988 | Maag | 272/117 |
| 4,846,458 | 7/1989 | Potts | 272/130 |

FOREIGN PATENT DOCUMENTS 334634A 6/1985 Fed. Rep. of Germany .

OTHER PUBLICATIONS

Recreation Unlimited Inc., Brochure.

*Primary Examiner*—Robert Bahr
*Assistant Examiner*—Lynne Reichard
*Attorney, Agent, or Firm*—Dodge, Bush, Moseley & Riddle

[57] ABSTRACT

An abdominal exercise machine is disclosed including a mechanism for allowing a chest pad disposed above a seat of the machine to move in a circular arc about the waist of a user sitting on the seat. The mechanism connecting a rotating member on which the chest pad is attached is disposed beneath the seat of the machine so as to allow easy mounting and dismounting by the user. Rotation of the chest pad is resisted by one of various resistance mechanism such as a viscous fluid resistance cylinder or stacked weights.

9 Claims, 2 Drawing Sheets

FIG. 1
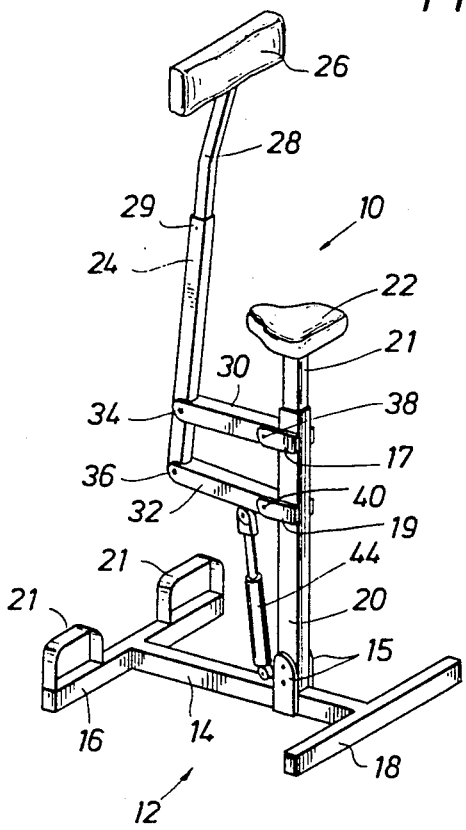
FIG. 2
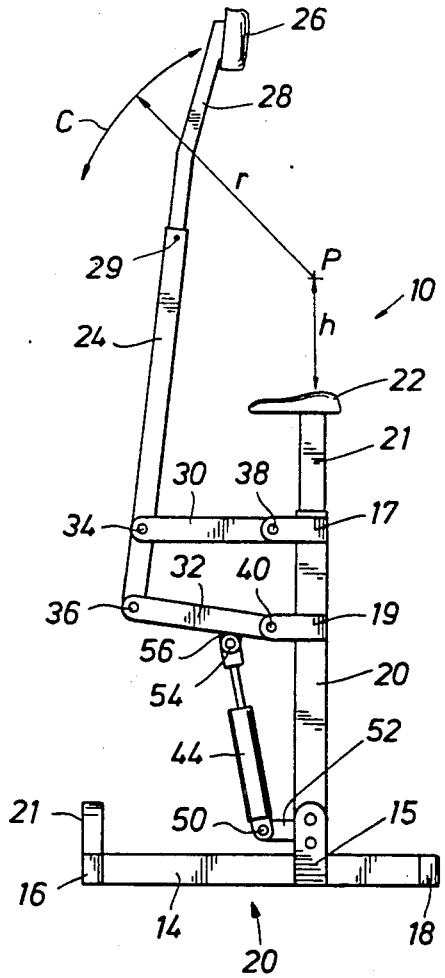
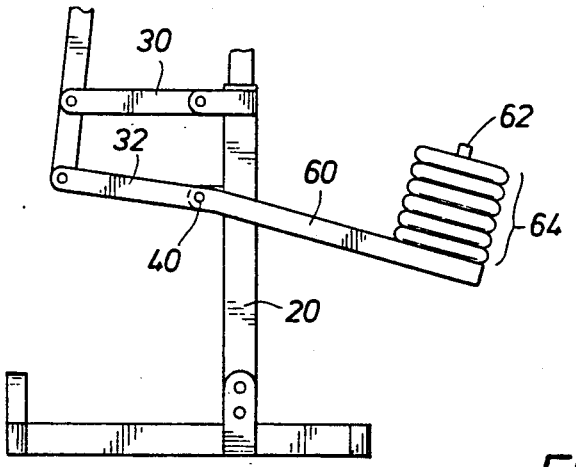
FIG. 3

ABDOMINAL EXERCISE MACHINE

This application is a continuation of application Ser. No. 542,521, filed June 22, 1990.

BACKGROUND OF THE INVENTION

1. Field of the Invention

This invention relates in general to exercise machines and in particular to machines for exercising abdominal muscles.

2. Description of Prior Art

Many machines have been proposed, some of which have been commercially produced, for allowing a person to exercise abdominal muscles. Examples of such machines are disclosed in U.S. Pat. Nos. 4,627,619, 4,623,144, 4,600,196 and 4,387,893. The machines of these patents allow a user to sit in the machine and bend forward at the waist, rather than the hip, so as to properly exercise the user's abdominal muscles. Such machines are all characterized by a fixed support member and a rotating member, with the rotating member having opposite pivot points on the support member which roughly align with the sternum or breastbone of the user. Such placement of the rotating members with respect to the stationary support member allows the user to push against the rotating member resulting in a circular arc about a line through the pivot points and the user's waist.

Other machines for exercising abdominal muscles while also exercising lower back muscles provide mechanisms which allow the user to bend backward from a seated position. The machine disclosed in U.S. Pat. No. 4,666,152 is an example of such a machine. Such machine includes back and lap supports with a mechanism which resists backward rotation by the user.

All of the machines of the type described above include structure tall enough to provide pivot points to align with the user's sternum. Consequently such machines include high supporting structure on both sides of the user which makes entry and exit to and from the machine cumbersome.

IDENTIFICATION OF OBJECTS OF THE INVENTION

An object of the invention is to provide an abdominal exercise machine, which allows side entry onto the machine, and which properly allows a user when exercising on the machine, to bend from his sternum or waist so as to exercise abdominal muscles.

Another object of the invention is to provide an abdominal exercise machine with a mechanical linkage located below the seat of the machine, which provides a circular arc of the chest pad about a center of rotation located above the seat.

SUMMARY OF THE INVENTION

The objects identified above, as well as other advantages and features of the invention, are incorporated in a machine having a base and a stationary support which is secured to the base and extends above it. A seat is secured to the top of the stationary support. A rotating support is provided which has a support or chest pad located at its upper end. The rotating support is rotatably connected at its lower end to the stationary support by way of a linkage. The linkage is arranged such that the chest pad moves in a circular arc about a center of rotation disposed at a point above the seat. The linkage arrangement defines such point to coincide with the waist or sternum of the user. In operation, the user sits on the seat of the machine with his chest against the chest pad. Forward motion of the rotating member causes the user's chest to rotate in a circular arc about his waist, thereby insuring proper motion for exercising abdominal muscles.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 1 is a perspective view of the abdominal muscle exercise machine according to the invention;

FIG. 2 is a side view of the machine of FIG. 2;

FIG. 3 is an illustration of an alternative resistance to motion mechanism; and

DESCRIPTION OF THE INVENTION

Figure 4A:
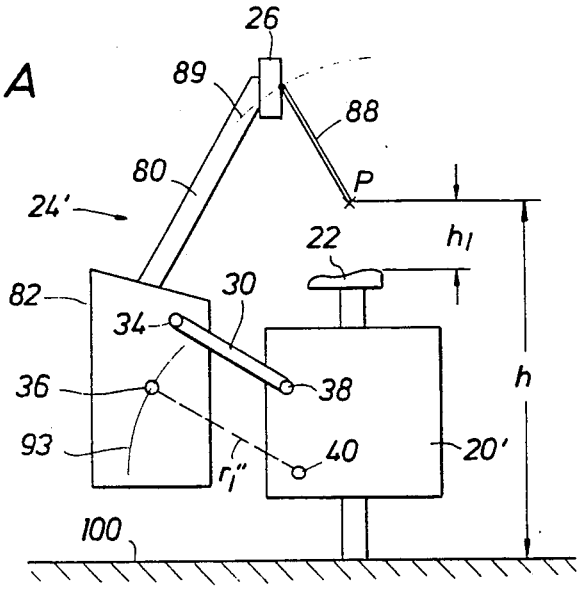
FIGS. 4A–4C are illustrations of design steps by which a linkage of the machine according to the invention may be defined.

FIGS. 1 and 2 illustrate the abdominal muscle exercising machine 10 according to the invention. The machine 10 includes a base 12 including a longitudinal member 14 with front 16 and back 18 lateral cross members. An upwardly extending stationary member 20 is secured to base 12 by means of brackets 15 in a conventional manner. Although the stationary member 20 is illustrated as extending vertically from base 12, it of course may extend upwardly at an angle from base 14.

A seat 22 is disposed atop stationary member 20 by means of a post 21 which is inserted within a hollow receiving portion at the top of stationary member 20 in a conventional manner. Post 21 may be fixed at a permanent height above member 20, or it may be provided with a clamping device (not shown) by which the seat 27 may be moved up or down with respect to member 20 so as to adjust the height depending on the height of a user of the machine 10.

The machine 10 includes a rotating member 24 having a lateral chest pad 26 fixed at its top end. An extension post 28 fits within a hollow portion of rotating member 24. A set screw 29 or the like secures extension post to rotating member 24 to enable the user of the machine 10 to adjust chest pad 26 to fit against his chest when the user is sitting astride seat 22.

The rotating member 24 is pivotally connected to stationary member 20 by means of upper and lower links 30 and 32. Upper link 30 is pivotally connected to rotating member 24 and to stationary member 20 by means of pins 34 and 38. Lower link 32 is pivotally connected to rotating member 24 and stationary member 32 by means of pins 36 and 40. Brackets 17 and 19, secured to stationary member 20, extend toward rotating member 24 from stationary member 20. Links 30 and 32 pivot with respect to brackets 17 and 19 by means of pins 38 and 40 extending through aligned holes of brackets 17 and upper link 30 and bracket 19 and lower link 32. Of course, links 30 and 32 may pivot directly about stationary member 20.

The length of upper link 30 and lower link 32, as well as the distances between upper pin 34 and lower pin 36 and upper pin 38 and lower pin 40 are selected, according to a procedure as described below, to cause the upper end of rotating member, (specifically the chest pad 26) to move substantially in a circular C path about a center of rotation P located at a height h above the seat 22. The height h is selected to coincide approximately with the waist of a user seated on seat 22. Consequently, a user seated on seat 22 with his chest pressed adjacent pad 26 bends in a circular arc about his waist as he bends forward against chest pad 26. The linkage, including links 30 and 32, and pivot pins 34, 36 to rotating member 24 and pivot pins 38, 40 to stationary member 20 (via brackets 17, 19) assures such circular movement of the user's chest with respect to his waist. An important advantage of the placement of links 30 and 32 below seat 22 is that a user of the machine may approach the machine and sit astride it on seat 22 without obstruction from side pieces extending at or above his waist as exists with many prior art abdominal exercise machines.

Resistance to the rotation of rotating member 24 with respect to stationary member 20 is provided in the embodiment of FIGS. 1 and 2 by means of viscous fluid resistance cylinder 44 connected between lower link 32 and stationary support member 20. Such cylinder 44 may be pivotally connected to stationary support member 20 by means of pin 50 through bracket 52 secured to member 20 and to link 32 by means of pin 54 through bracket 56 secured to link 32.

Alternatively, resistance to the rotation of rotating member 24 with respect to stationary member 20 may be provided, as illustrated by FIG. 3, by means of stacked weights 64 and pin 62 of extension 60 to lower link 32. Other resistance means, known in the exercise machine art, of course may also be used.

Figure 4B:
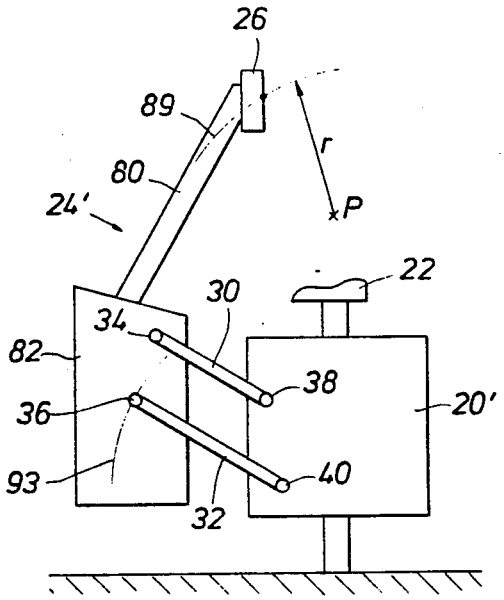

FIGS. 4A and 4B illustrate how the lengths and placement of links 30 and 32 and the placement of pivots 38, 34, 36 and 40 may be established to assure that the center of rotation of chest pad 26 is about a point P disposed at the waist of a user sitting astride the machine. FIG. 4A illustrates that point P is assumed to be at height h, typically about twenty inches above floor 100. The height $h_1$ above seat 22 to point P is established as the average distance to a user's waist from his buttocks while in a seated position. A stationary frame 20' and a rotating member 24' are established with link 30 extending from pivot 38 of stationary frame 20' to pivot 34 of rotating member 82. They may be established at an upward angle as illustrated so that rotating member 24 (or member 82) does not contact the floor 100 on its downward arc.

A temporary "helper" link 88 is placed on chest pad 26 which is secured to member 80 which extends upwardly from member 82 of rotating member 24'. The length of link 88 is established as the length between the waist and the chest of an average user while sitting astride seat 22. Link 88 is then fixed so that it may pivot about point P.

Next, the mechanism of FIG. 4A is moved such that chest pad 26 moves in a circular arc 89 about point P by virtue of an end of helper link 88 being fixed at point P. An arbitrary pivot point 36 is established on member 82 and its circular arc 93 is noted in response to the movement of rotating member 24' about point P with helper link 88. The center of rotation of arc 93 is then fixed at point 40 on stationary member 40 along the radius "r" of arc 93.

Figure 4C:
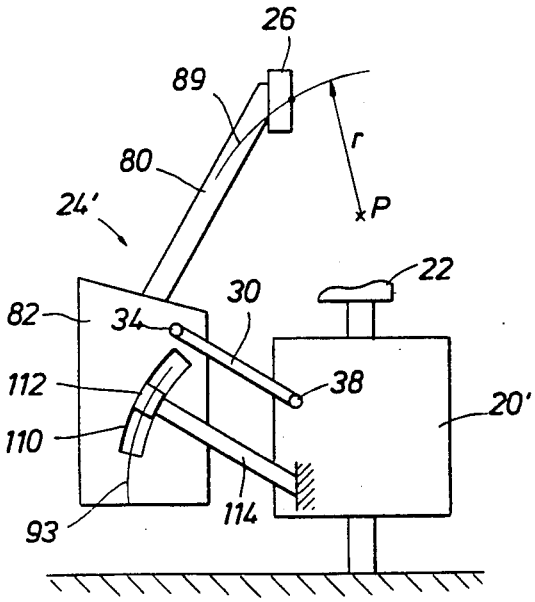

Finally, as illustrated in FIG. 4B, the helper link 88 is removed, and a permanent link 32 is established between pivot points 36 and 40. Movement of rotating member 24' with links 30 and 32 in place between member 82 and 20' causes member 82 to continue to move in a circular arc 93 about pivot 40 because of link 32, which in turn assures that chest pad 26 will move in a circular arc of radius r about point P. Alternatively, as illustrated in FIG. 4C a slot 110 may be established in member 82 along the circular path 93. A slide 112 fixed in position with respect to stationary member 20', for example by fixed link 114, then slides within slot 110 as rotating member 24' moves with respect to stationary member 20'. As a result, chest pad 26 moves in a circular arc 89 about point P.

Various modifications and alterations in the described apparatus will be apparent to those skilled in the art of the foregoing description which does not depart from the spirit of the invention. For this reason, these changes are desired to be included in the appended claims. The appended claims recite the only limitations of the present invention and the descriptive manner which is employed for setting forth the embodiments and is to be interpreted as illustrative and not limitative.

What is claimed is:

1. An exercising machine comprising a base, a stationary support member, secured to said base, and extending upwardly above said base, a seat with means for securing it to the top of said stationary support member, a rotating support member supported on said stationary support member having upper and lower ends, said rotating member including a support pad at its upper end, linkage means pivotally connecting said rotating support member at its lower end to said stationary support member below said seat for allowing said support pad of said rotating member to move in a substantially circular path about a center of rotation located at a height above said seat, wherein said linkage means includes, an upper link and a lower link, said lower link pivotally connected to said lower end of said rotating support member and to said stationary support member respectively at first and second lower pivot points, said upper link pivotally connected to said lower end of said rotating support member and to said stationary support member respectively at first and second upper pivot points, said second lower and upper pivot points being on said stationary support member below said seat and in vertically spaced relation to each other, the lengths of said upper link and said lower link and the distances between said first upper pivot point and said first lower pivot point and between said second upper pivot point and said second lower pivot point being selected to cause said support pad of said rotating member to move in said circular path about said center of rotation above said seat, wherein said center of rotation is located approximately at the waist of a person sitting on said seat of the machine.

2. The machine of claim 1 wherein said securing means is adjustable for allowing said seat to be varied in height above said stationary support member thereby allowing people of different heights to align their waists to said center of rotation.

3. The machine of claim 1 comprising foot restraining means secured to said base for providing support for a person sitting on said seat of the machine while exercising.

4. The machine of claim 1 further comprising resistance means connected to said rotating support member for resisting movement of said rotating support member with respect to said stationary support means.

5. The machine of claim 4 wherein said resistance means is a viscous fluid resistance cylinder connected between said linkage means and said stationary support member.

6. The machine of claim 4 wherein said resistance means is a variable weight connected to said linkage means.

7. The machine of claim 1 wherein said linkage means includes an upper link and a lower link, said lower link pivotally connected to said lower end of said rotating support member and to said stationary support member respectively at first and second lower pivot points, said upper link pivotally connected to said lower end of said rotating support member and to said stationary support member respectively at first and second upper pivot points, said second lower and upper pivot points being on said stationary support member below said seat and in vertically spaced relation to each other, the lengths of said upper link and said lower link and the distances between said first upper pivot point and said first lower pivot point and between said second upper pivot point and said second lower pivot point being selected to cause said support pad of said rotating member to move in said circular path about said center of rotation above said seat.

8. The machine of claim 1 wherein said stationary support member extends upwardly from said base in a generally vertical direction beneath said seat thereby to permit access to said seat by a person using siad machine from opposed sides of the seat.

9. An exercising machine comprising a base, a stationary support member, secured to said base, and extending upwardly above said base, a seat with means for securing it to the top of said stationary support member, a rotating support member supported on said stationary support member having upper and lower ends, said rotating member including a support pad at its upper end, a four-bar linkage means connected between said stationary support member at a location beneath said seat and said lower end of said rotating support member for pivotally connecting said rotating support member to said stationary support member, the linkage of said four-bar linkage dimensioned for causing said support pad of said rotating member to move in a substantially circular path about a center of rotation located at a height above said seat, wherein said center of rotation is located approximately at the waist of a person sitting on said seat of the machine.

* * * * *